US006450261B1

(12) United States Patent
Baugh

(10) Patent No.: US 6,450,261 B1
(45) Date of Patent: Sep. 17, 2002

(54) FLEXIBLE SWEDGE

(75) Inventor: John L. Baugh, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 14 days.

(21) Appl. No.: 09/685,264

(22) Filed: Oct. 10, 2000

(51) Int. Cl.[7] ..... E21B 29/10; E21B 43/10

(52) U.S. Cl. ..... 166/277; 166/216; 166/217; 166/391

(58) Field of Search ..... 166/217, 380, 166/386, 207, 209, 216, 211, 277

(56) References Cited

U.S. PATENT DOCUMENTS

| | | | | |
|---|---|---|---|---|
| 1,769,350 A | * | 7/1930 | Langstaff | 72/120 |
| 1,981,525 A | * | 11/1934 | Price | 166/102 |
| 3,067,801 A | * | 12/1962 | Sortor | 166/207 |
| 3,785,193 A | * | 1/1974 | Kinley et al. | 166/277 |
| 4,502,308 A | * | 3/1985 | Kelly | 29/421.1 |
| 4,608,739 A | | 9/1986 | Miller | |
| 5,613,557 A | | 3/1997 | Blount et al. | |
| 6,012,523 A | | 1/2000 | Campbell et al. | |
| 6,098,717 A | | 8/2000 | Bailey et al. | |
| 6,112,818 A | | 9/2000 | Campbell | |
| 6,142,230 A | * | 11/2000 | Smalley et al. | 166/207 |

FOREIGN PATENT DOCUMENTS

| | | | | |
|---|---|---|---|---|
| GB | 2346165 A | * | 8/2000 | E21B/7/04 |

* cited by examiner

*Primary Examiner*—David Bagnell
*Assistant Examiner*—Daniel P Stephenson
(74) *Attorney, Agent, or Firm*—Steve Rosenblatt

(57) ABSTRACT

A swedge assembly is disclosed which has the capability of allowing for a sealing connection between an inner tubular and an outer tubular where the outer tubular has significant out of roundness. A resilient segment or segments is disposed on the swedge in contact with the inner tubular to be expanded so as to fill any voids created by out of roundness of the outer tubular. The resilient material may be an elastomer or any pliable metallic or any other material compatible with the applicable well bore conditions.

19 Claims, 2 Drawing Sheets

FLEXIBLE SWEDGE

FIELD OF THE INVENTION

The field of this invention relates to swedges, tubular expansion devices, which can seal an inner pipe to an outer pipe by expansion when the outer pipe is somewhat out of round without need to expand the outer pipe.

BACKGROUND OF THE INVENTION

In the past, techniques have been developed to expand and inner pipe against an outer pipe and such techniques have been applied to attach a liner to casing in a well bore. Because segments of well bore casing could be out of round prior techniques have required a swedge system to have sufficient power to not only expand the inner tubular but also to expand the outer tubular to insure fixation in a full circumferential manner of the inner tubing against the outer tubing. This technique illustrated in U.S. Pat. No. 6,098,717 required the inner tubular to be expanded beyond the yield point by drawing a swedge through it. The inner tubular expanded sufficiently such that the elastic recovery for the inner tubular was less than the elastic recovery for the outer tubular to insure that the tubulars sealed against each other. While this technique was effective, it required significant amount of pulling force or applied horsepower on the swedge.

However, there are applications where the power available to drive the swedge is limited but the circumstances still call for a reliable sealed connection between the inner tubular and the outer tubular in circumstances where the outer tubular could be somewhat out of round. It is therefore an object of the present invention to be able to accommodate situations where the outer tubular is out of round and expand an inner tubular assembly in such a manner as to fully seal in the portions of the outer tubular which are out of round. It is a further object of the present invention to reduce the required applied force driving the swedge to make a sealed connection between the inner and outer tubulars. Those advantages and others will be readily apparent to those skilled in the art from a review of the description of the preferred embodiment which appears below.

SUMMARY OF THE INVENTION

A swedge assembly is disclosed which has the capability of allowing for a sealing connection between an inner tubular and an outer tubular where the outer tubular has significant out of roundness. A resilient segment or segments is disposed on the swedge in contact with the inner tubular to be expanded so as to fill any voids created by out of roundness of the outer tubular. The resilient material may be an elastomer or any pliable metallic or any other material compatible with the applicable well bore conditions.

DETAILED DESCRIPTION OF THE PREFERRED EMBODIMENT

Figure 1:
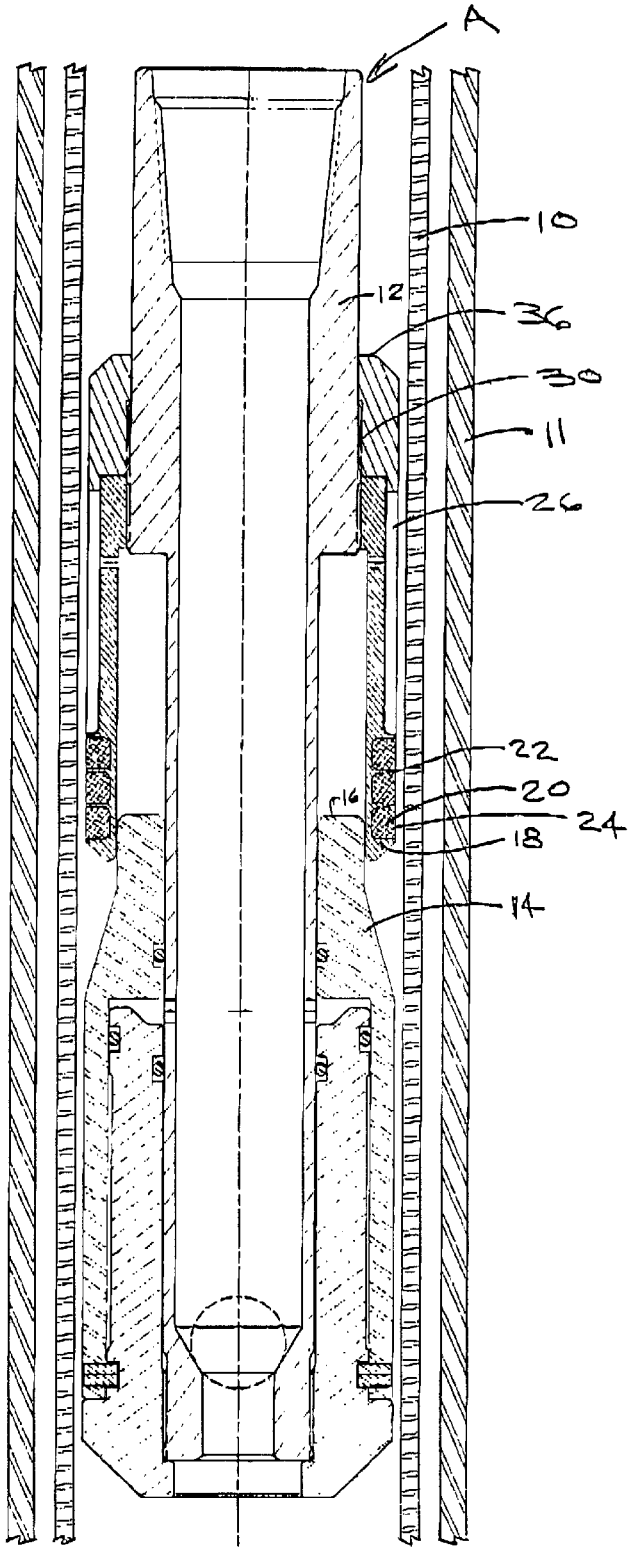
FIG. 1 is a section view of the apparatus in the run in position.

Referring now to FIG. 1, the apparatus A is shown inserted into an inner tubular 10 which is in turn in a bigger tubular or casing 11. The apparatus has a mandrel 12 to which is attached a movable tapered component or wedge 14. Wedge 14 can be operated hydraulically with pressurized gas mechanically or by other means.

Referring to FIG. 1, it can be seen that the wedge 14 has a leading end 16 which sits under an inner sleeve 18. Inner sleeve 18 holds one or more seals 20. Seals 20 can be made from non-metallics, soft metals, composite materials, plastics, or any other material compatible with down hole well conditions chemically, thermally, and mechanically. Some examples of usable materials would include aluminum, elastomers, and PFFE. The seals 20 are disposed in peripheral grooves such as 22 so that each seal 20 has an outer face 24 which can engage the inner tubular 10 to expand it against the casing 11 as shown on FIG. 2.

An outer sleeve 26 is retained to mandrel 12 by thread 30. Outer sleeve 26 has longitudinal splits 34 which are shown on FIG. 2 as increasing in size due to the expansion caused by advancing the wedge 14. The splits 34 do not go to the end 36 of the outer sleeve 26 thereby creating a plurality of finger-like segments 38 which expand to engage the inner tubular 10.

Figure 2:
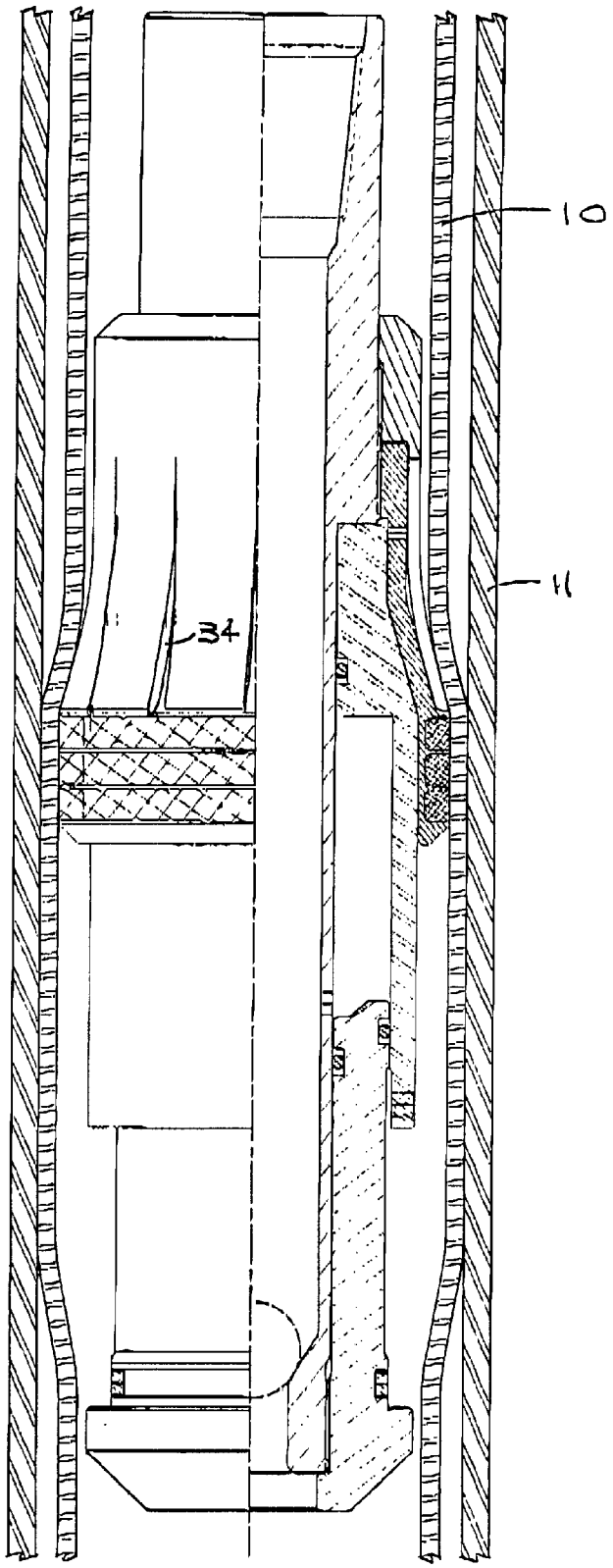
FIG. 2 is a section view of the apparatus in the expanded position.

In operation, the well bore casing 11 receives a smaller tubular or casing such as 10 to be expanded into contact with it. The wedge 14 is operated to effectively increase the size of the tubular 10 into sealing contact with casing 11. FIG. 2 shows the inner sleeve 18 along with the one or more seals 20 after expansion of the tubular 10 against its surrounding casing 11. The advantage of the seal or seals 20 can now readily be appreciated. In the event there are out of roundness conditions in the casing 11 against which the tubular 10 is to be expanded, greater expansion of the tubular 10 can occur to confirm tubular 10 to those irregularities because internally the seal or seals 20 respond to the increased loading due to the out of roundness in the casing 11 so as to allow tubular 10 under the redistributed force through the seal or seals 20 to expand further in the locale of the surrounding casing 11 where it is larger due to out of roundness. Out of roundness as large as ±0.060 inches or more can be accommodated in this manner. In essence, the ability of the seal or seals 20 to distribute the load allows for compensation for out of roundness in the surrounding casing or tubular 11 into which the tubular 10 must be expanded. In essence, the rigid components of the apparatus A accomplish a majority of the necessary expansion of the tubular 10 in the order of 95 percent or more of the requisite expansion to firmly engage the tubular 10 to most of its surrounding outer casing 11. The presence of the seal or seals 20 allows additional expansion forces to be applied to further expand the tubular 10 into any voids caused by out of roundness in the surrounding tubular. The softness of the seals 20 gives a fluid type property to the seal allowing it to equalize the load circumferentially so that further expansion can take place where there is less resistance due to out of roundness and a circumferential seal of 360° can be obtained as between the tubular 10 and its surrounding casing 11 due to the further expansion facilitated by the seal or seals 20 into any void areas in the surrounding casing.

By using the apparatus A the power requirements are greatly reduced because there is no requirement to appreciably expand the casing 11 to accomplish the seal as was the case in U.S. Pat. No. 6,098,717.

Those skilled in the art will appreciate that the above described preferred embodiment is illustrative of the invention and the scope of the invention is determined by the claims below.

I claim:

1. A method of expanding an inner tubular into a surrounding out of round tubular comprising:

inserting an expansion tool into the inner tubular;

inserting a portion of said inner tubular into said surrounding out of round tubular;

providing a load distributing feature on said expansion tool which allows for said distributing by continuous contact for 360 degrees with said inner tubular;

expanding said inner tubular into circumferential contact with said surrounding out of round tubular.

2. The method of claim 1, comprising:

providing a resilient material in said expansion tool as said load distributing feature;

using said resilient material to apply the requisite expansion force to said inner tubular for contact with an out of round segment of said surrounding tubular.

3. The method of claim 2, wherein:

providing at least one circumferential ring of said resilient material on said expansion tool.

4. The method of claim 3, comprising:

locating said material in a peripheral groove.

5. The method of claim 4, comprising:

using rigid portions of said expansion tool for expansion of said inner tubular to at least 95% of its final dimension.

6. The method of claim 1, comprising:

obtaining 360° sealing contact with said out of round surrounding tubular.

7. The method of claim 6, comprising:

avoiding significant expansion of said surrounding tubular.

8. A method of expanding an inner tubular into a surrounding out of round tubular comprising:

inserting an expansion tool into the inner tubular;

inserting a portion of said inner tubular into said surrounding out of round tubular;

providing a load distributing feature on said expansion tool;

expanding said inner tubular into circumferential contact with said surrounding out of round tubular;

providing a resilient material in said expansion tool as said load distributing feature;

using said resilient material to apply the requisite expansion force to said inner tubular for contact with an out of round segment of said surrounding tubular;

providing at least one circumferential ring of said resilient material on said expansion tool;

locating said material in a peripheral groove;

using rigid portions of said expansion tool for expansion of said inner tubular to at least 95% of its final dimension; and using said resilient material to complete the remaining expansion of said inner tubular into full 360° circumferential contact with said out of round surrounding tubular.

9. A method of expanding an inner tubular into a surrounding out of round tubular, comprising:

inserting a portion of said inner tubular into said surrounding out of round tubular;

applying an expansion force to said inner tubular;

distributing said expansion force over a continuous 360 degrees to a portion of said inner tubular that needs to expand further to contact a void caused by out of roundness of said surrounding outer tubular;

minimizing expansion of said out of round tubular by virtue of said distributing of said expansion force.

10. The method of claim 9, comprising:

providing a resilient material in an expansion tool;

inserting said expansion tool into said inner tubular;

using said resilient material to provide the requisite expansion force of said inner tubular for contact with an out of round segment of said surrounding tubular.

11. The methods of claim 10, comprising:

providing at least one circumferential ring of said resilient material on said expansion tool.

12. The method of claim 11, comprising:

locating said resilient material in a peripheral groove.

13. An expansion tool for expanding an inner tubular into a surrounding out of round tubular comprising:

a mandrel;

a movable wedge on said mandrel;

at least one non-segmented sleeve expandable by said wedge into said inner tubular;

a continuous load distributing device on said sleeve which facilitates incremental expansion of an inner tubular into voids due to out of roundness in the surrounding tubular.

14. The tool of claim 13, wherein:

said load distributing device comprises a resilient material.

15. The tool of claim 14, wherein:

said resilient material forms a ring shape on said sleeve.

16. An expansion tool for expanding an inner tubular into a surrounding out of round tubular comprising:

a mandrel;

a movable wedge on said mandrel;

at least one sleeve expandable by said wedge into said inner tubular;

a load distributing device on said sleeve which facilitates incremental expansion of an inner tubular into voids due to out of roundness in the surrounding tubular, said load distributing device comprises a resilient material;

said resilient material forms a ring shape on said sleeve; and a plurality of resilient ring shapes on said sleeve.

17. The tool of claim 16, further comprising:

an inner sleeve comprising exposed peripheral grooves in which said resilient ring shapes are disposed.

18. The tool of claim 17, comprising:

an outer sleeve mounted over a portion of said inner sleeve and further comprising at least one longitudinal split that extends for a majority of its length.

19. The tool of claim 18, comprising:

a drive for said wedge powered mechanically, hydraulically, or by pressurized gas.

* * * * *